United States Patent [19]

Hamblin

[11] 4,027,440

[45] June 7, 1977

[54] EXTENSIBLE INTERLOCKING STRUCTURE OF MULTI-LATERAL CROSS-SECTION

[75] Inventor: Leslie Frank Hamblin, Shrewsbury, England

[73] Assignee: Alan Salisbury Lamburn, Kencott, England; a part interest

[22] Filed: July 22, 1975

[21] Appl. No.: 598,039

[52] U.S. Cl. ..... 52/108; 52/646; 182/41

[51] Int. Cl.[2] ..... E04H 12/18

[58] Field of Search ..... 52/108, 109, 111, 114, 52/121, 645, 646, 123; 182/40, 41; 343/880–882; 254/139.1

[56] References Cited

UNITED STATES PATENTS

| | | | |
|---|---|---|---|
| 1,531,982 | 3/1925 | Sago | 182/41 |
| 2,375,461 | 5/1945 | Bender | 52/108 |
| 2,375,462 | 5/1945 | Bender | 52/108 |
| 2,481,471 | 9/1949 | Crot | 52/108 |
| 2,574,657 | 11/1951 | Pierce | 52/108 X |
| 2,661,082 | 12/1953 | Ziegler | 52/108 |
| 2,767,812 | 10/1956 | Boger | 52/108 |
| 2,806,562 | 9/1957 | Harman | 52/108 |
| 2,844,232 | 7/1958 | LeRoy | 52/108 |
| 2,855,617 | 10/1958 | Broms et al. | 52/646 X |
| 3,751,863 | 8/1973 | Lyons | 52/121 X |

FOREIGN PATENTS OR APPLICATIONS

| | | | |
|---|---|---|---|
| 558,583 | 3/1957 | Italy | 52/646 |
| 498,806 | 4/1954 | Italy | 52/646 |

*Primary Examiner*—Leslie Braun
*Attorney, Agent, or Firm*—Edward F. Connors

[57] ABSTRACT

An extensible interlocking structure suitable for tower cranes, scaffolding towers and the like is of multilateral cross-section and has two sets of main members which engage one another in end-to-end relation when the structure is extended. Tie members are pivoted to the main members, with the free ends of the tie members interlocking automatically with the main members during extension to provide diagonal bracing. On retraction the members may be stored on drums or in a rack.

10 Claims, 19 Drawing Figures

EXTENSIBLE INTERLOCKING STRUCTURE OF MULTI-LATERAL CROSS-SECTION

This invention relates to extensible structures.

One object of this invention is to provide an extensible interlocking structure which is rigid on being extended, but which on retraction is automatically unlocked to allow storage of the component parts.

Another object of the invention is to provide an extensible interlocking structure which is suitable for tower cranes, scaffolding towers and the like, and which may readily be extended or retracted.

On extension, the structure has features which lock in place to ensure rigidity, and on retraction the elements of the structure may be readily stored on a drum, or side-by-side in a magazine or rack.

The structure is sufficiently compact to be readily transportable on a truck, and yet to form a high tower.

In certain forms the structure may be extended horizontally, or at any desired angle, in addition to vertically.

According to this invention, an extensible structure includes two sets of main members, the sets being spaced apart but not co-planar, the members of each set being arranged to engage one another in substantially end-to-end relation when the structure is extended, at least one set of tie members pivoted to at least one set of main members, the ends of the tie members which are free before extension of the main members being arranged, during extension of the main members, to interlock with the opposed set of main members, and a member inter-connecting the free ends of both sets of main members, whereby on extension of the structure the sets of main members are interconnected and held in spaced-apart relationship to form a rigid structure.

According to a feature of the invention, each main member in at least one set is a generally rectangular frame.

According to another aspect of the invention, an extensible structure includes two sets of successive members, each member being engaged with the next member of the set on extension of the structure, one set having tie members adapted, on extension of the structure, to extend into engagement with the other set, and the other set having features which, on extension, lock the tie members in place, to hold the sets in spaced-apart relationship, to form a rigid structure.

According to yet another aspect of the invention, there is provided apparatus including an extensible structure as set forth, means for carrying the frames before extension and means for feeding the frames from their carrying means to the extended position.

A number of embodiments of the invention will now be described by way of example, with reference to the accompanying drawings.

Figure 1:
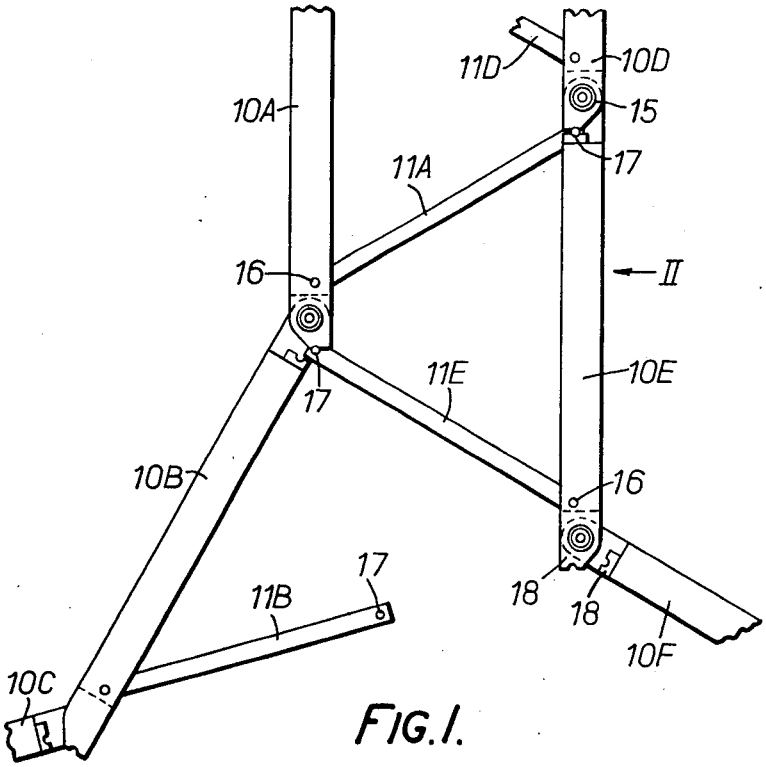
Figure 2:
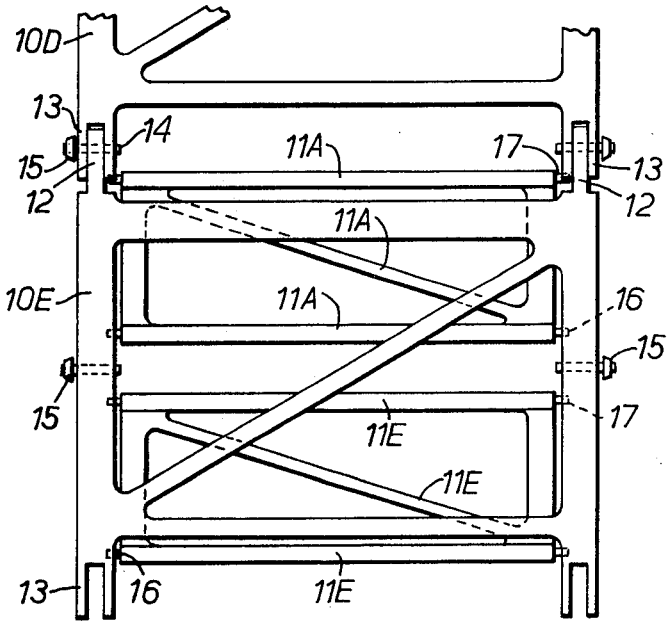
Figure 3:
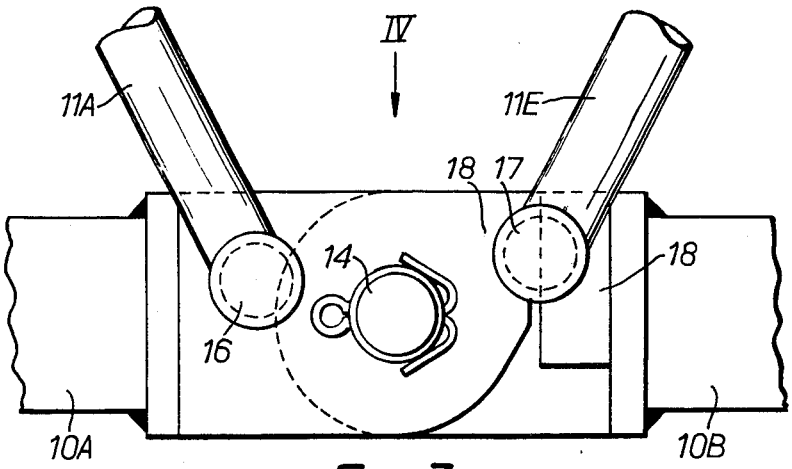
Figure 4:
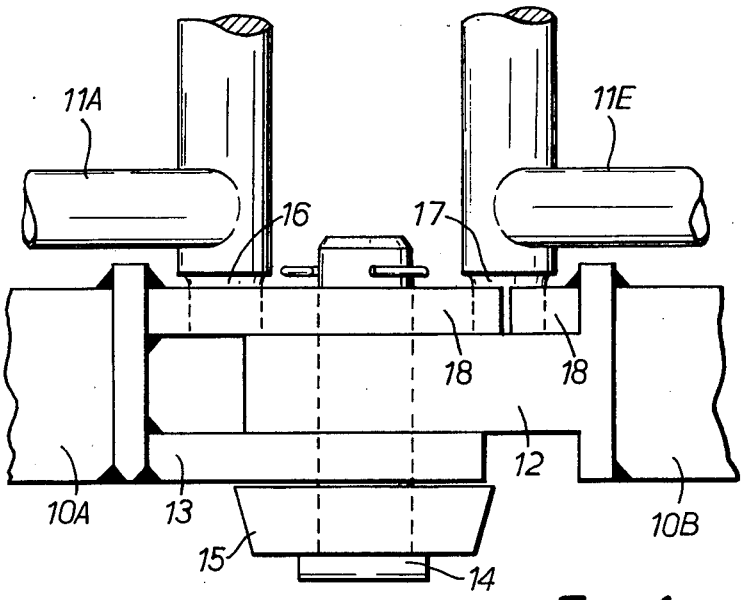
Figure 5:
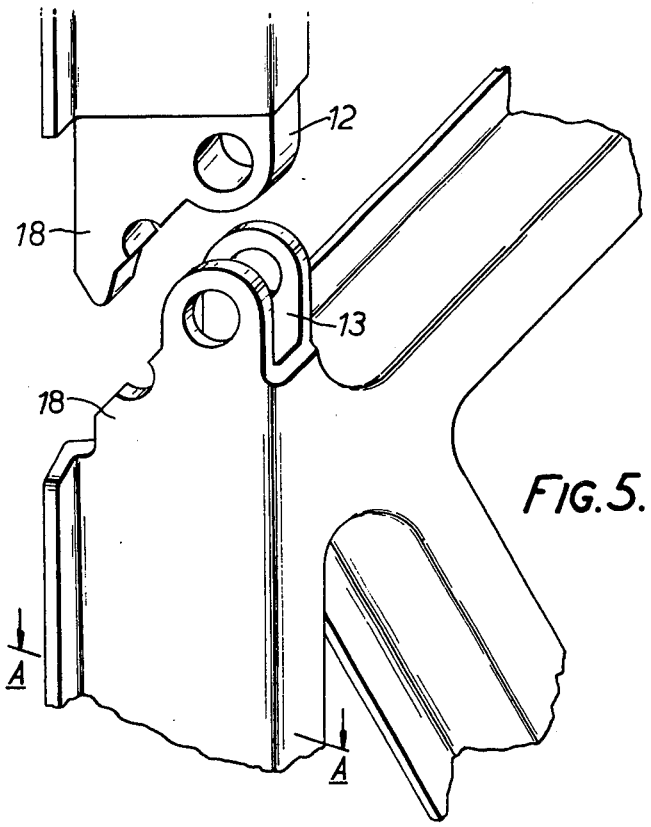
Figure 6:
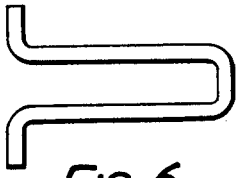
Figure 7:
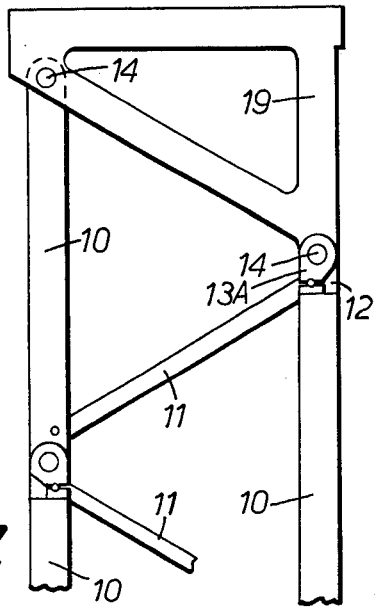
Figure 8:
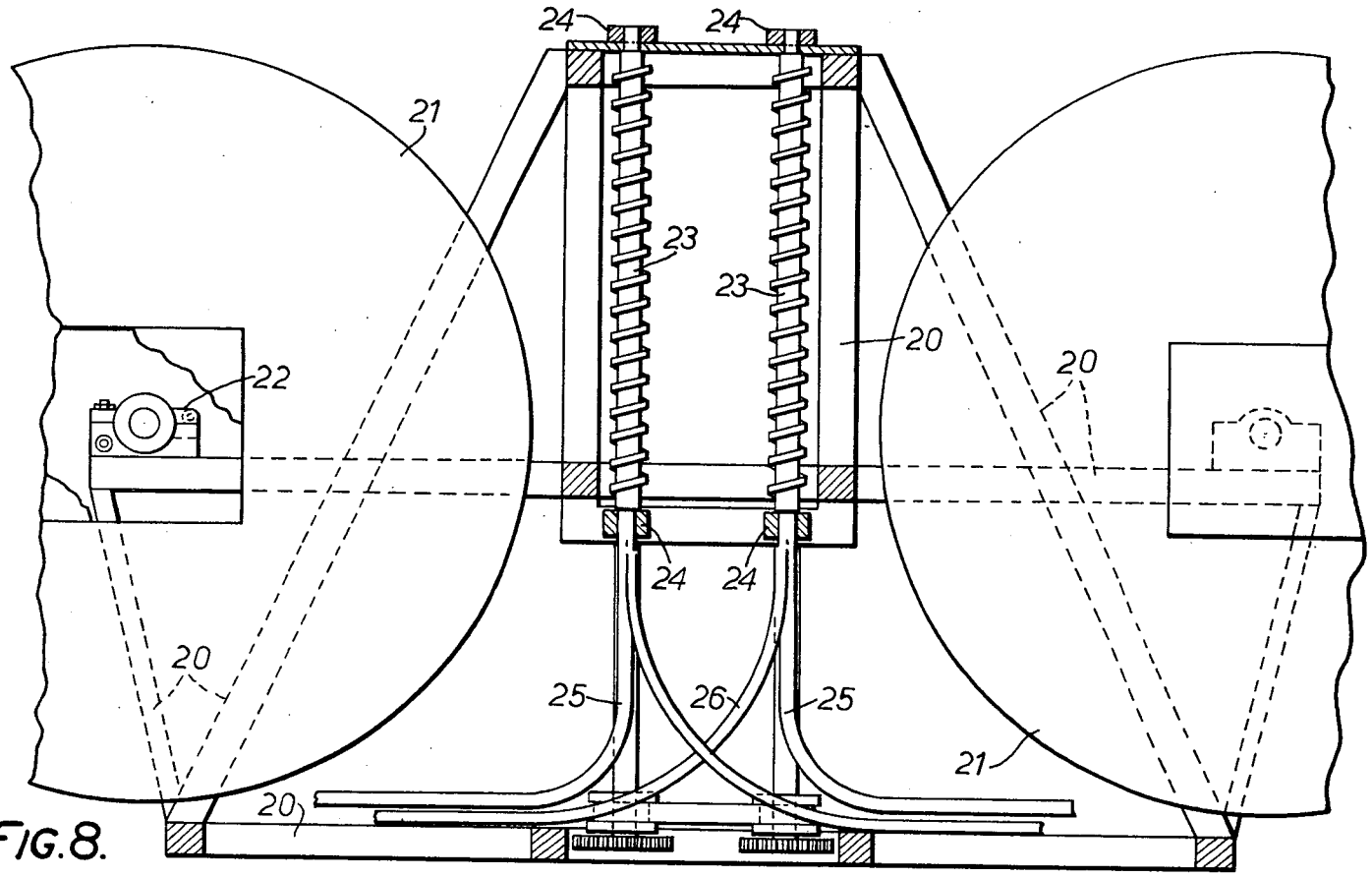
Figure 9:
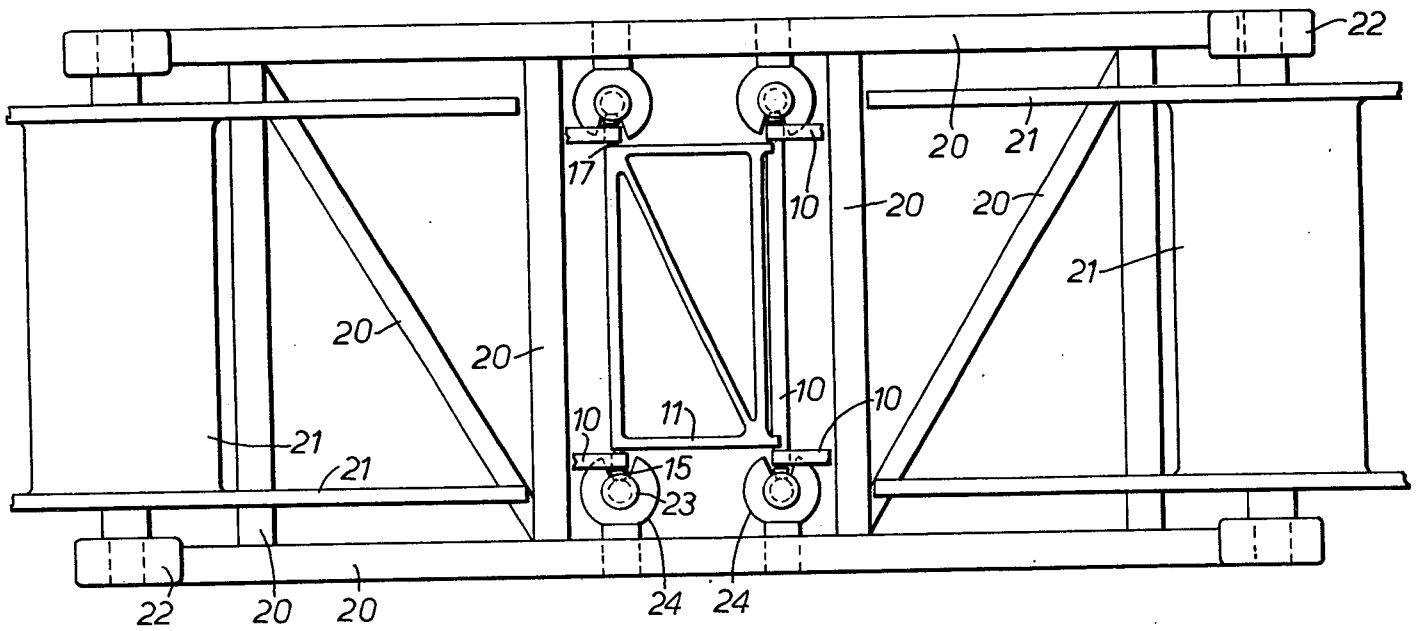
Figure 10:
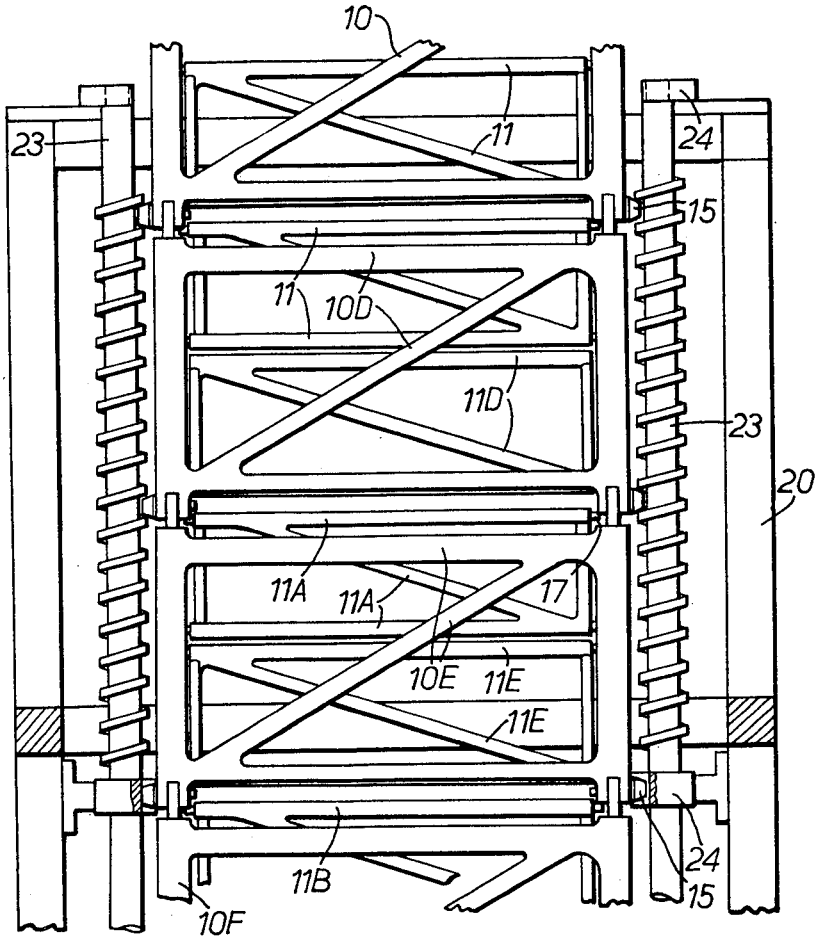
Figure 16:
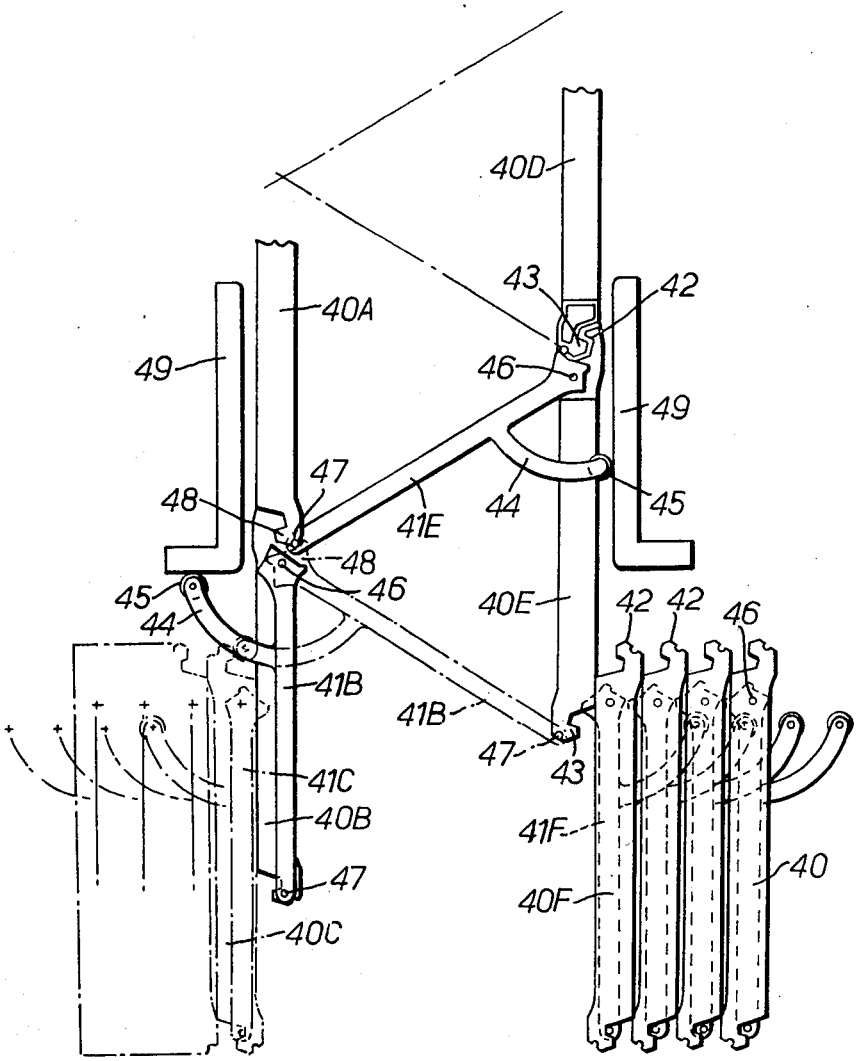
Figure 17:
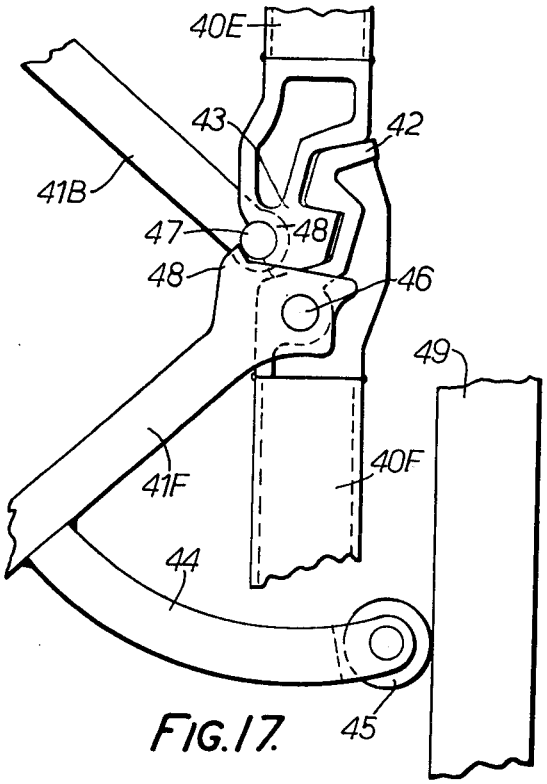
Figure 18:
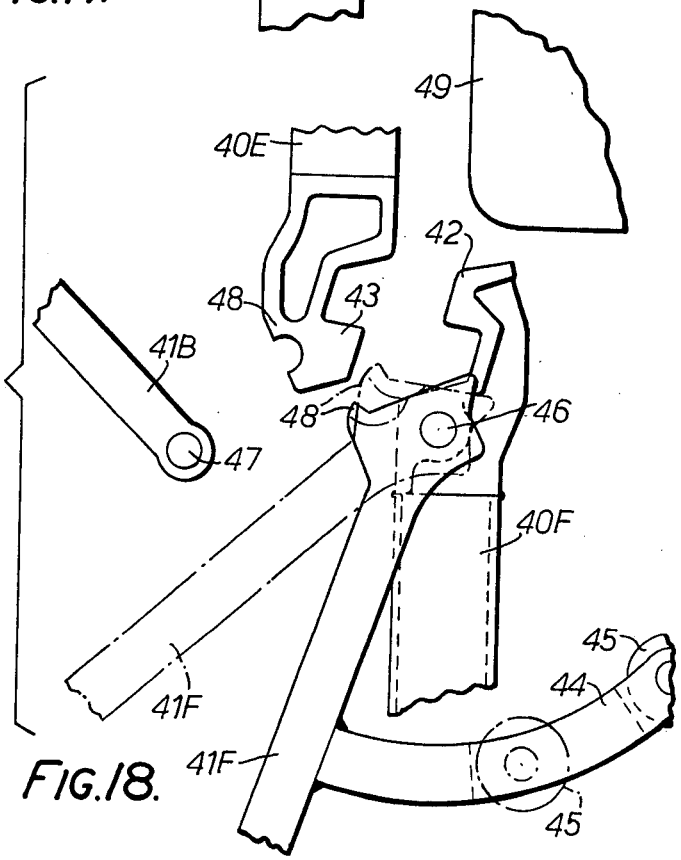
Figure 19:
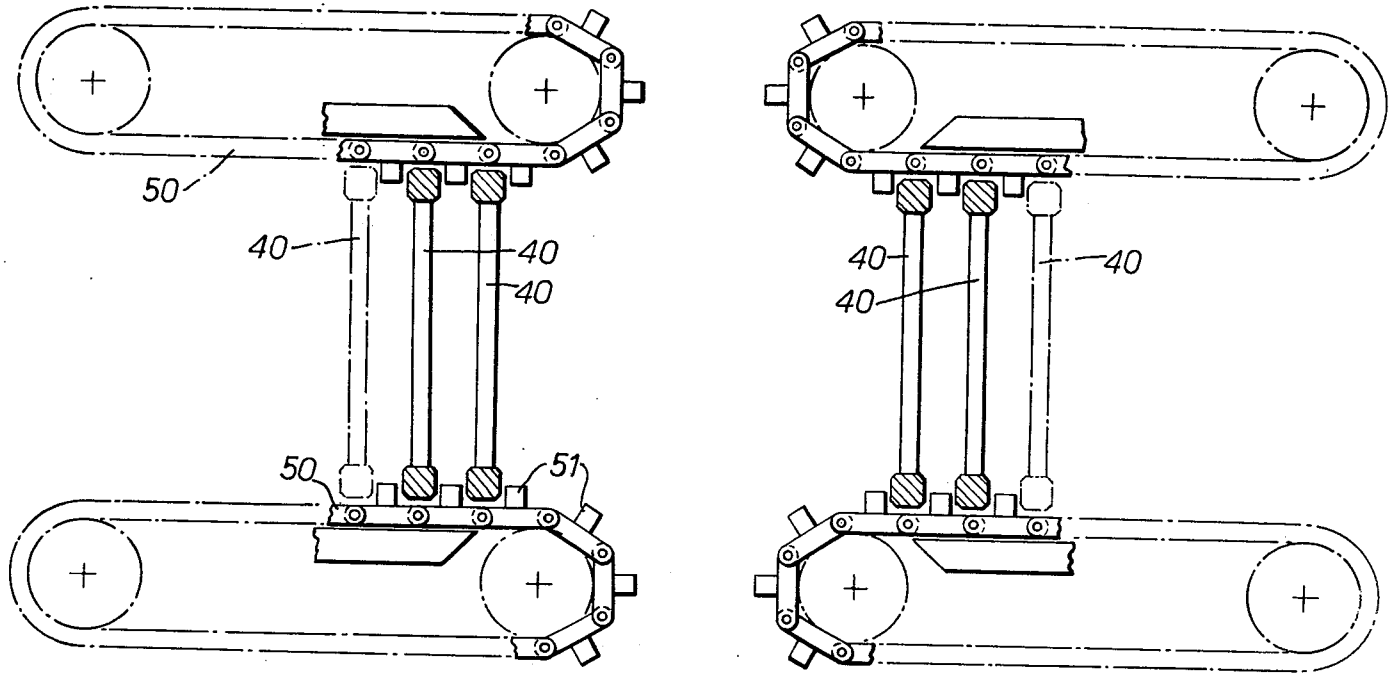

FIG. 1 is a diagrammatic elevation of a structure in accordance with the invention, FIG. 2 is a diagrammatic elevation of the structure of FIG. 1 viewed at right angles to FIG. 1, FIG. 3 is part of the structure of FIG. 1 on an enlarged scale, FIG. 4 is a view on the arrow IV in FIG. 3, FIG. 5 is a modification of the structure of FIGS. 1–4, FIG. 6 is a section on the line A—A of FIG. 5, FIG. 7 is a view similar to FIG. 1 showing the top of the structure, FIG. 8 is an elevation of the extension and retraction apparatus of the structure, FIG. 9 is a plan view of the apparatus of FIG. 8, FIG. 10 is an elevation of part of the apparatus of FIG. 8, viewed at right angles to that Figure, FIGS. 11 – 15 are diagrammatic views of another embodiment of structure in accordance with the invention, FIG. 16 is a diagrammatic view corresponding to FIG. 1 of yet another embodiment of structure in accordance with the invention, FIG. 17 is a detail of part of FIG. 16, FIG. 18 is an exploded view of the embodiment of FIGS. 16 and 17, and FIG. 19 is a plan view of apparatus forming part of the structure of FIGS. 16 – 18.

Referring to FIGS. 1 – 4, there is shown part of a structure which is capable of being extended and retracted, and which may be used, for example, as part of a crane. The structure is rectangular in plan view, and is rigid when extended; it is arranged so that certain parts automatically disengage on retraction, and automatically engage on extension, so that the parts may be conveniently stored when not in use.

The structure has main frames 10, which are generally rectangular and each of which is rigid, and tie frames 11 which are also generally rectangular and rigid. The main frames 10 are arranged in two sets which, when extended, lie in two parallel planes; one set 10A, 10B, 10C, is seen on the left of FIG. 1 and the other set 10D, 10E, 10F on the right of FIG. 1. Successive main frames 10 in the left-hand set are hinged together, as are successive main frames in the right-hand set, by means of a pair of tongues 12 (FIGS. 2 and 4) at the top of one frame engaging in a pair of forks 13 at the bottom of the next frame and being secured by pivot pins 14. Each pivot pin 14 has a roller 15 rotatably mounted on its outer end, for reasons which will be explained below.

Each main frame 10 has one of the tie frames 11 pivoted to it by means of trunnions 16 engaging in holes in the main frame 10, and for reference each tie frame will be given the same suffix as the main frame to which it is pivoted. At the end farther from trunnions 16, each tie frame 11 has a pair of trunnions 17 one at each side, and as the structure is extended the trunnions 17 are guided into and engaged in jaws 18 formed partly in the tongue 12 and partly in the fork 13 (FIGS. 3 and 4); thus for example, one set of jaws is formed partly in main frame 10A and partly in main frame 10B, this set of jaws receiving the trunnions 17 formed on the free end of tie frame 11E. The jaws 18 have part-circular depressions which come together to form a circular hole when the frames 10 are brought into alignment. When the frames 10 are inclined to one another during the extension process, there is room for a trunnion 17 to pass into the open jaw 18.

Instead of the frames being formed of steel tube, as illustrated in FIGS. 1 – 4, they may be made of pressings as shown in FIG. 5, having, for example, a deep top-hat section as seen in FIG. 6. The jaws 18 and tongue 12 and fork end 13 may be formed as separate fittings, and welded or otherwise attached to the pressings.

Referring to FIG. 7, there is shown one form of member 19 for ensuring that the upper end of the structure does not collapse on extension; as shown the member 19 is triangular in elevation and has forked parts 13A which engage with tongues 12 at the top end of the uppermost main frames 10.

During the extension process the main frames pass successively through the positions 10C, 10B, 10A, (FIG. 1) and the tie frames 11 are guided, for example by their trunnions 17, so that the trunnions enter the open jaws 18 before these close as the main frames 10 reach the vertical position.

On extension, the frames 10, 11 are lifted by means of rollers 15, and retraction is controlled by corresponding means. The extension and retraction may be affected by the apparatus shown in FIGS. 8, 9 and 10, which has a structural framework 20 on which two drums or reels 21 are mounted in bearings 22, the axes of which are parallel to those of the pins 14. The drums carry the linked frames 10 and tie frames 11, wound around their circumference.

The structural framework also carries four vertical leadscrews 23 in bearings 24 the distance apart of the leadscrews being related to the spacing of opposite rollers 15, so that the rollers engage in the leadscrews (as shown in FIG. 9). To extend the structure, the leadscrews 23 are rotated in synchronism by means of a motor and gearing (not shown) and the rollers 15 which are initially engaged with the leadscrews are drawn upward, unwinding the frames 10, 11 from the drums 21. Succeeding rollers 15 are drawn off the drums along inward-facing channel-section guides 25 which guide the rollers into the leadscrews 23. At the same time, the trunnions 17 are drawn along similar channel-section guides 26, which position them so that they enter the jaws 18 as described above. There may be one guide 26 on each side of the frames 10 as seen in plan, the guides being of opposite senses, and the tie frames 11 and pivots 16 being made sufficiently stiff that the unguided trunnion 17 of each pair is correctly positioned.

Continued operation will keep drawing the frames 10, 11 off the drums 21 and discharging the structure from the top of the leadscrews 23.

On reversal of the direction of rotation of the leadscrews 23, the structure will be retracted, the jaws 18 will automatically open as the frames 10 pivot out of alignment as the rollers 15 come down the guides 25, and the trunnions 17 will be guided down, so that the frames 10, 11 are guided downwards and back onto the drums 21.

Figure 14:
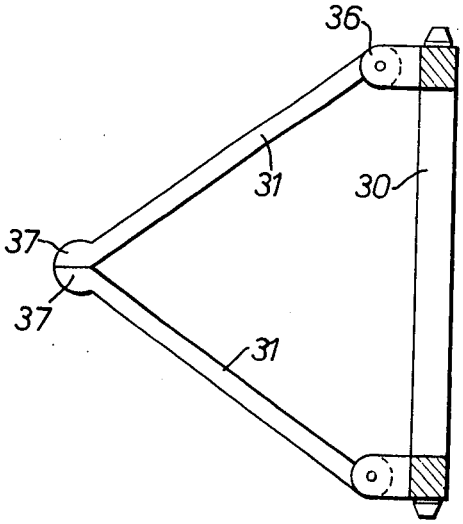
Figure 15:
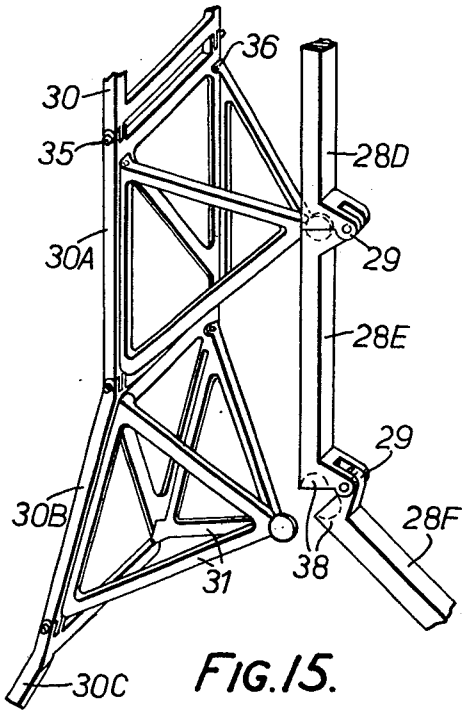
Figure 13:
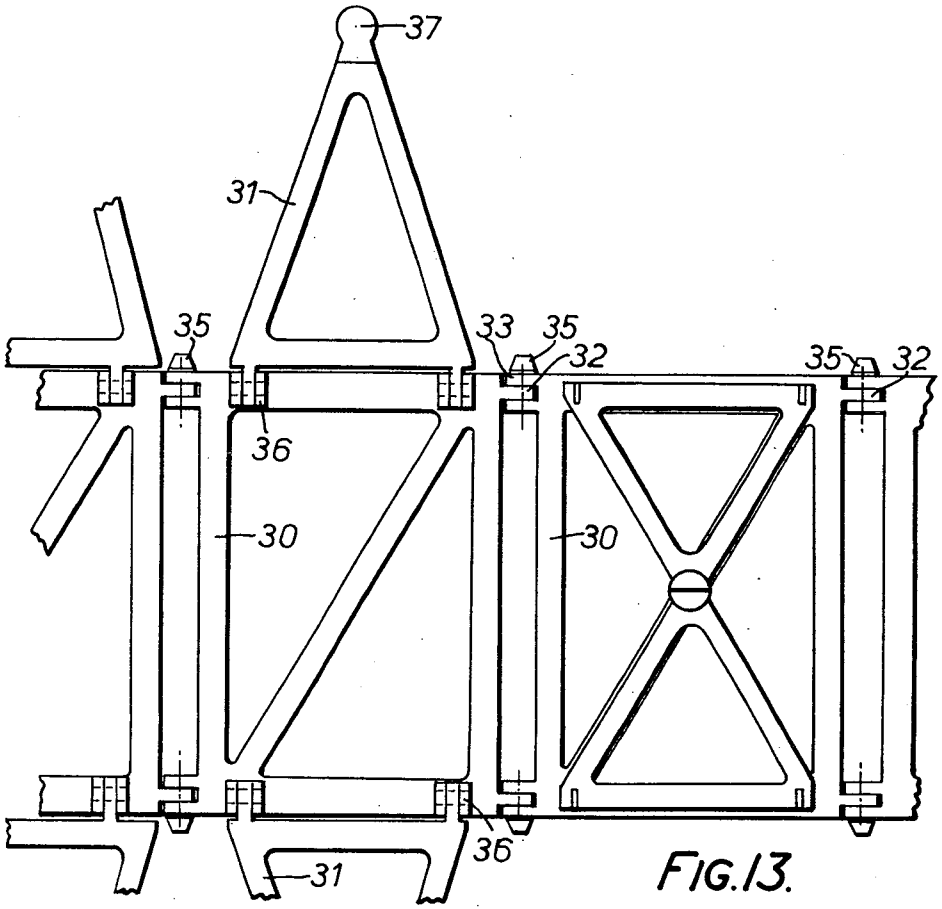

Referring now to FIGS. 11 – 15, there is shown a corresponding structure but which is triangular in plan view. In this structure one side (seen on the right of FIG. 15) consists of a set of linked struts 28D, 28E, 28F with offset hinges 29 to form between them upper and lower jaws 38 which meet, on closing, in horizontal planes. Means are provided, for example including rollers and guides similar to rollers 15 and guides 25 described above, for causing the struts to be drawn off a storage drum, and to move from the position shown at 28F to that shown at 28E, on extension of the structure. The other side of the structure (seen on the left of FIG. 15, and in more detail, in different positions, in FIGS. 11 – 14) has a set of main frames 30, 30A, 30B, 30C, hinged together by means of tongues 32 secured in forks 33 by pins. The outer ends of the pins are formed with rollers 35, by means of which the frames may be drawn off a drum by use of leadscrews as described in the previous embodiment. A pair of triangular arms 31 are pivotally mounted on each main frame 30 by means of pin joints 36, the axis of which (assuming that the structure is extended vertically) is vertical. The free end of each triangular arm 31 carries a half-ball 37, so arranged that when the two arms 31 come together (as seen in FIG. 14) a spherical end is formed at the apex of a pyramid, the joint-plane between the two half-balls 37 being vertical.

Figure 11:
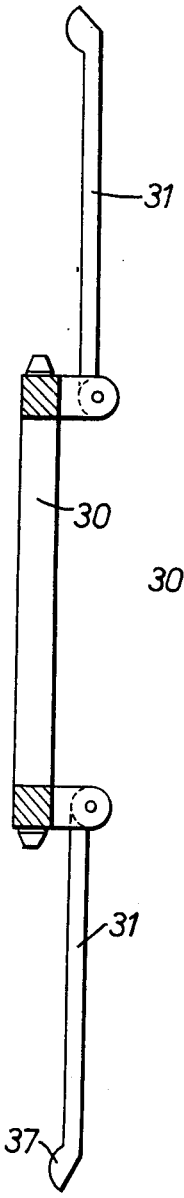
Figure 12:
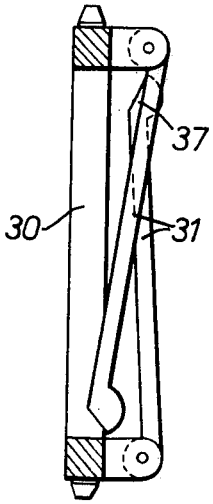

The frames 30 may be stored either with their arms 31 as shown in FIG. 11, or as shown in FIG. 12. In the former case the arms are merely guided to come together, in the position shown in FIG. 14, when the two half-spherical ends 37 are guided between the jaws 38 as the latter close. In the latter case, however, the uppermost arm 31 must then be guided out beyond its final position, the lowermost arm 31 must then be guided to its final position, and the uppermost arm guided back into contact with it.

It will be appreciated that in this construction also a member equivalent to member 19 is necessary, in order to prevent the jaws 38 from opening after the structure is extended.

Referring now to FIGS. 16 – 19, there is shown another embodiment of extensible structure in accordance with the invention. The structure is rectangular in plan view, and has two sets of main frames 40 as in the first embodiment. A tie frame 41 is pivotally connected to each main frame. However, in this embodiment the two sets of frames are stacked in two magazines, as seen in FIG. 16. Instead of being hinged together, the main frames 40 have inter-engaging hooked features 42, 43; as the main frame 40E is lifted by the extension mechanism the next main frame 40F in the magazine is indexed to the left (as seen in FIG. 16) by a mechanism to be described below, for the hook 42 to engage hook 43 on main frame 40E. At the same time as the main frame 40E is lifted, it carries with it tie frames 41E; the latter has an arm 44 carrying a roller 45, which engages with a stationary guide 49 and causes the frame 41E to pivot about the trunnion 46 by which it is hinged to the main frame 40E, so that the trunnion 47 on the free end of the tie frame 41E engages in a jaw 48 formed on the lower end of main frame 40A, the other jaw 48 forming the pair being on the end of tie frame 41B nearest its pivot. This latching mechanism is shown in greater detail in FIGS. 17 and 18 (note that in FIG. 18 the lower main frame 40F is for the sake of clarity shown offset in relation to the upper frame 40E and the stationary guide 49). In FIG. 17 the features 42, 43 are engaged, and the trunnion 47 is trapped in the jaws 48, which have been closed by swinging of tie frame 41F from its vertical stacked position to its final position as a result of engagement of the roller 45 and the stationary guide 49. The tie frame 41F is held in this position as the structure is lifted, until its free end is locked by similar action on the part of tie frame 41C carried by main frame 40C. The tie frame 41F, in closing on trunnion 47, locks hook 43 in engagement with hook 42 of main frames 40E, 40F.

In FIG. 18 the features 42, 43 are shown before engagement, and with trunnion 47 not engaged in jaws 47; the tie frame 41F is also shown in an intermediate position (solid line) and in substantially its final position in relation to frame 40F (chain line).

On retraction of the structure, the stationary guide 49 holds successive tie frames 41 in engagement with the appropriate opposed main frame, until the following tie frame is likewise supported through its arm 44.

In order to move the frames 40, 41 into position in the magazine for the features 42, 43 to engage, a sprocket chain drive as shown in FIG. 19 may be used; this consists of two pairs of endless chains 50 having projecting sprocket teeth which engage the two ends of the frames. The chains are driven in timed relation so that the frames are maintained at right angles to their direction of movement, and the frames are brought into engagement from opposite magazines alternately; the final engagement of features 42, 43 may be urged by a suitable spring incorporated either in the frames or in the sprocket chain.

Guides are provided to maintain the frames 40 in parallel planes as shown in FIG. 16, and a leadscrew arrangement may be used as in the previous embodiments for extension and retraction of the structure.

The embodiment of FIGS. 16 – 19 may have an alternative arrangement, instead of the arms 44, rollers 45 and stationary guides 49, which are satisfactory for a vertically extensible structure, but would not be satisfactory for a horizontally extensible structure unless the rollers 45 were constrained in a guide channel.

In the alternative arrangement, each tie frame 41 is formed on its outside surface with a projecting cam or nose (clearly seen in FIGS. 17 and 18 below and to the right of the trunnion 46) which is arranged to co-operate with a roller mounted to rotate about a fixed axis on the framework 20, so that engagement of the cam or nose with the roller, as it passes the roller on extension of the structure 40, 41 causes the tie frame 41 to swing from its retracted, vertical position (as seen in the stack of main frames 40 in FIG. 16) to its diagonal position in which its trunnion 47 engages with the opposite set of frames. An over-centre spring is provided, one end of which is connected to the tie frame 41, and the upper end of which is connected to the main frame 40 near hook 42. Thus, referring to FIGS. 17, 18, when the tie frame 41 is in its retracted, vertical position the line of action of the spring is to the right of trunnion 46, holding the tie frame 41 retracted; when the tie frame 41 has been caused by the cam and roller to extend, the line of action of the spring is to the left of the trunnion 46, urging the trunnion 47 into engagement with the opposite set of frames.

Instead of a toggle spring, a suitable detent may be used.

It will be clear to those skilled in the art that the embodiments described are by way of example only, and various modifications may be made within the scope of the invention.

I claim:

1. An extensible interlocking structure of multi-lateral cross-section comprising two sets of main members, at least one set consisting of generally rectangular rigid frames which lie in a first plane spaced apart from a second plane in which the members of the other set lie, the main members of each set engaging one another in end-to-end relation when the structure is extended, at least one set of tie members, said tie members being pivoted about a pivot axis to said main members of at least one set, and said tie members having, before extension of the main members, free ends remote from said pivot axis, said main members of the set opposed to said tie members being formed with depressions to afford jaws to receive the free ends of said tie members, extension of said sets of main members causing said jaws to close to grip said tie members, whereby to form a rigid structure with said sets of main members held in spaced-apart relationship by said tie members extending diagonally therebetween, and a member interconnecting the free ends of both sets of main members.

2. An extensible interlocking structure as claimed in claim 1, comprising two sets of tie members, each set of tie members being pivoted about respective pivot axes to the corresponding sets of main members, said tie members having, before extension of the main member, free ends remote from the respective pivot axes, both sets of main members opposed to the respective tie members being formed with depressions to afford jaws to receive the free ends of said tie members.

3. An extensible interlocking structure as claimed in claim 1, in which successive main members of each set are hinged together.

4. An extensible interlocking structure as claimed in claim 1, in which one set of main members comprises a set of generally-rectangular frames, successive frames being hinged together, and the other set of main members comprises a set of linked struts, the structure when extended having a triangular transverse cross-section.

5. An extensible interlocking structure as claimed in claim 4, in which each tie member is formed at its free end with a part-spherical surface, there being two tie members pivoted to each main member, the part-spherical surfaces of two tie members hinged to a main member co-operating together, and adjacent parts of successive linked struts having corresponding concave part-spherical surfaces arranged to encompass and retain the co-operating part-spherical surfaces of the two tie members.

6. An extensible interlocking structure as claimed in claim 1, wherein each main member in both said sets of main members is a generally-rectangular frame, the frames engaging with one another in end-to-end relation when the structure is extended, there are two sets of the members, each tie member being a generally-rectangular frame, and each tie member being pivoted about a pivot axis to the corresponding main member, said tie members having trunnions on their free ends, and the main members of both sets being formed with features affording jaws, the trunnions being gripped in said jaws, whereby to form a rigid structure when said main members have been extended.

7. An extensible interlocking structure of quadrilateral cross-section comprising two sets of main members each having a generally-rectangular rigid frame, one set lying in a first plane which is spaced apart from and in opposed relation to a second plane in which the members of the other set lie, the main members of each set being hinged together in end-to-end relation, two sets of tie members, said tie members being pivoted about a pivot axis to the respective main members of said two sets, said tie members having trunnions at the free ends remote from said pivot axis, said two sets of main members being formed with depressions to afford jaws to receive said trunnions, extension of said sets of main members causing said jaws to close to grip said trunnions, whereby to form a rigid structure, with said sets of main members held in spaced-apart relationship by said tie members extending diagonally therebetween, and a member interconnecting the free ends of both sets of main members.

8. An extensible structure as claimed in claim 7 comprising also a plurality of rollers extending from said sets of main members and coaxial with an axis about which the main members are hinged together, and leadscrew means engaging with said rollers, whereby on rotation of said leadscrew means said structure is extended and retracted depending on the direction of rotation.

9. An extensible interlocking structure of trilateral cross-section, comprising two sets of main members, one set having generally-rectangular rigid frames and the other set comprising a series of linked struts, both sets being hinged together in end-to-end relation, and one set lying in a first plane which is spaced apart from and in opposed relation to a second plane in which the members of the other set lie, two sets of triangular arms forming tie members, said triangular arms being pivoted about a pivot axis to said generally-rectangular frames, and said triangular arms having free ends remote from said pivot axis, said linked struts being formed with depressions to afford jaws to receive the free ends of said tie members, extension of said sets of main members causing said jaws to close to grip the free ends of said triangular arms whereby to form a rigid structure with said sets of main members held in spaced-apart relationship by said triangular arms, and a member interconnecting the free ends of both sets of main members.

10. An extensible interlocking structure of quadrilateral cross-section, comprising two sets of main members each having a generally-rectangular frame, one set lying in a first plane which is spaced apart from a second plane in which the members of the other set lie, and two corresponding sets of generally-rectangular tie members, each tie member being pivoted about a pivot axis to a corresponding main member, said tie members having trunnions at the free ends remote from said pivot axis, the main members having inter-engaging hooked means, means to extend said structure by lifting said main frames when the latter are in an operative position, means to move succeeding frames into said operative position, whereby, when one said main frame is lifted, the succeeding frame has its hooked means engaged with the co-operating hooked means of said one main frame, the main members being formed with depressions, and the tie member connected to each main member being formed with a jaw, said depression and said jaw receiving a said trunnion, extension of said sets of main members causing said jaws to close to grip said trunnions, whereby to form a rigid structure, with said sets of main members held in spaced-apart relationship, by said tie members extending diagonally therebetween, and a member interconnecting the free ends of both sets of main members.

* * * * *